US006657383B2

(12) United States Patent
Matsushima et al.

(10) Patent No.: US 6,657,383 B2
(45) Date of Patent: Dec. 2, 2003

(54) DISCHARGE LAMP OF THE SHORT ARC TYPE

(75) Inventors: Takeo Matsushima, Himeji (JP); Yasuro Kikuchi, Takasago (JP); Kyosuke Fujina, Shiso-Gun (JP)

(73) Assignee: Ushiodenki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/163,510

(22) Filed: Jun. 7, 2002

(65) Prior Publication Data

US 2002/0185972 A1 Dec. 12, 2002

(30) Foreign Application Priority Data

Jun. 11, 2001 (JP) ..... 2001-175362

(51) Int. Cl.[7] ..... H01J 1/62
(52) U.S. Cl. ..... 313/517; 313/594
(58) Field of Search ..... 313/570, 594, 313/596, 601, 602, 607

(56) References Cited

U.S. PATENT DOCUMENTS

2001/0010447 A1 8/2001 Yamane et al.

FOREIGN PATENT DOCUMENTS

| | | |
|---|---|---|
| JP | 02-199765 | 8/1990 |
| JP | 02-199766 | 8/1990 |
| JP | 02-210750 | 8/1990 |

*Primary Examiner*—Vip Patel
(74) *Attorney, Agent, or Firm*—Nixon Peabody LLP; David S. Safran

(57) ABSTRACT

A discharge lamp of the short arc type having a trigger wire which can be installed in a state which is suitable for a directional capacity of the electrode regardless of what type of base the lamp has is achieved by the trigger wire on the outside surface of an arc tube having the following characteristic:

an annular area that is formed by a portion of the trigger wire which is looped around the arc tube and elastically held against the outside surface of the arc tube;

a first holding part which adjoins a first end of the portion of the trigger wire that forms the annular area and which extends in an axial direction along the arc tube;

a second holding part which adjoins a second end of end of the portion of the trigger wire that forms the annular area and which extends in the axial direction along the arc tube.

2 Claims, 4 Drawing Sheets

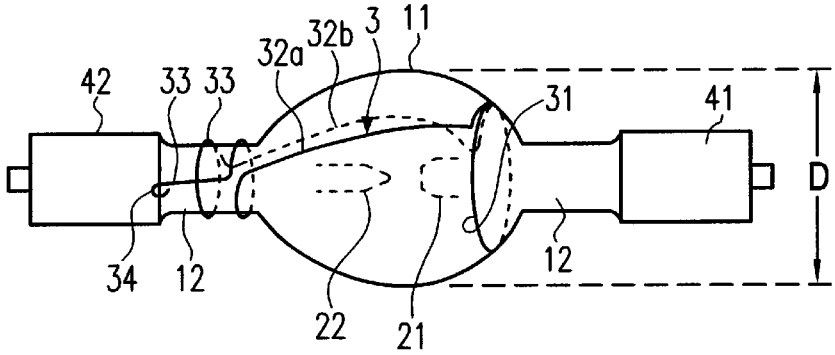
Fig.1
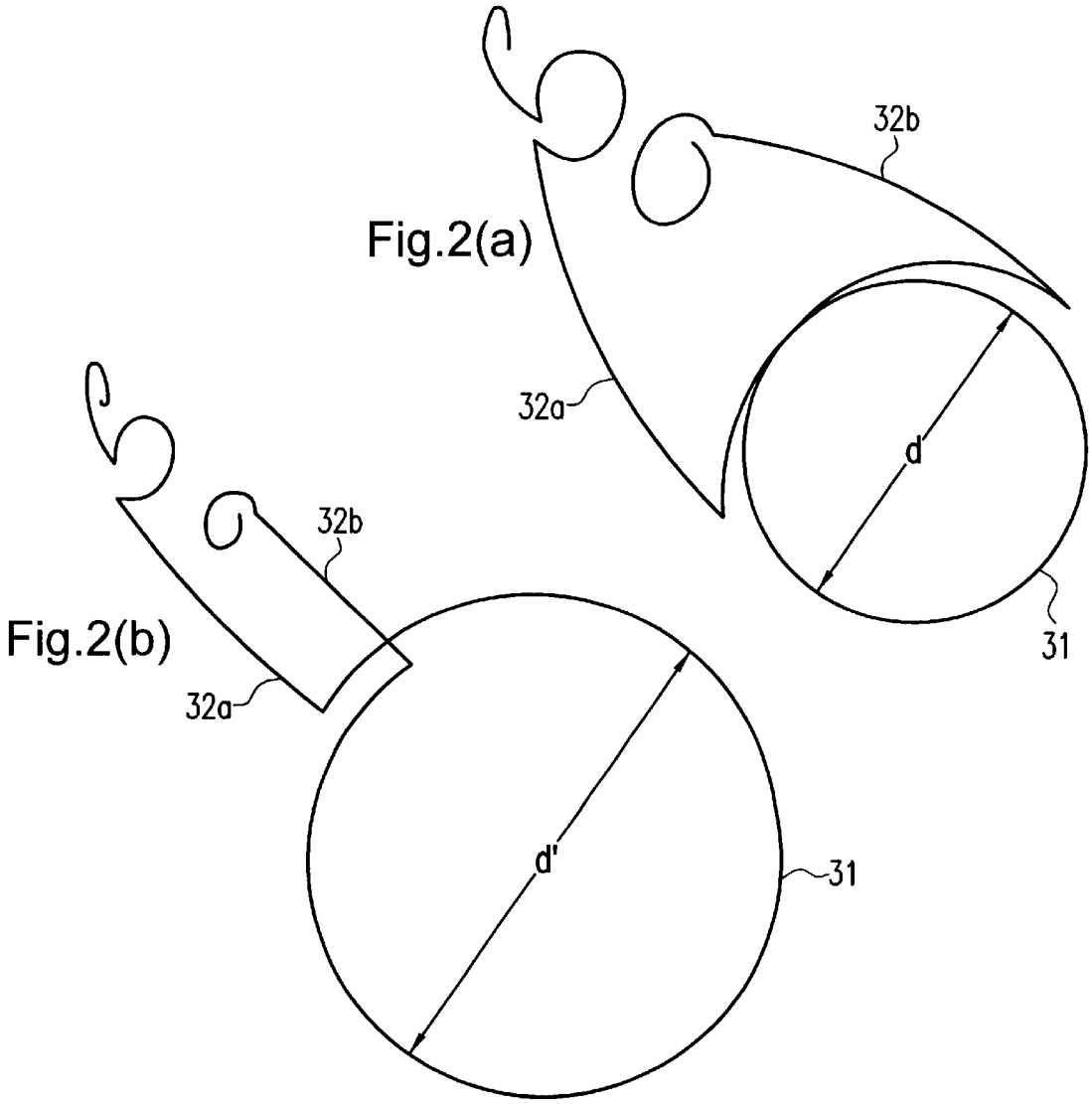
Fig.2(a)
Fig.2(b)

DISCHARGE LAMP OF THE SHORT ARC TYPE

BACKGROUND OF THE INVENTION

1. Field of the Invention

The invention relates to a discharge lamp of the short arc type which is used, for example, as a light source for a projection apparatus and is filled with xenon, or discharge lamp of the short arc type which is used as a light source in semiconductor exposure and is filled with mercury.

2. Description of the Related Art

In a discharge lamp of the short arc type which is filled, for example, with xenon, there are cases in which the breakdown voltage is greater than or equal to 30 kV, by which the voltage charge of the operating device is significantly raised. Here, there is the disadvantage that the starting voltage of the operating device punctures and the disadvantages of increasing the size of the operating device and increasing costs. Proceeding from such a circumstance, there is a trigger wire located on the outside surface of the arc tube and thus the breakdown voltage of the lamp is reduced.

FIG. 4 is a schematic of a conventional discharge lamp of the short arc type in which the outside surface of the arc tube is provided with a trigger wire. In the figure, an arc tube 11 contains a pair of electrodes, specifically an anode 21 and a cathode 22. The outside surface of the arc tube 11 is provided with a trigger wire 5. The trigger wire 5 is formed with an annular area 51 which is in contact with the outside surface of the arc tube 11. Furthermore, there is a holding part 52 which is connected to this annular area 51 and which extends in the lengthwise direction of the lamp. Part of this holding part 52 is wound around a side tube part 12 which adjoins the arc tube and is attached and is connected to the base 42 on one end of the holding part 52.

FIG. 5 shows a perspective view of only the trigger wire 5. Here, the holding part 52 is connected by welding or the like to a part of the annular area 51 which is formed in the shape of an uninterrupted ring. The annular area 51 has elasticity to the extent to which it is deformed by application of a force. The length of the wire-like component comprising the annular area 51 is however always constant and never changes. The diameter d of the annular area 51, in the state before its installation on the arc tube 11, is smaller than the maximum diameter D of the arc tube shown in FIG. 4. By inserting the annular area 51 from the direction of the base 41 into the lamp the annular area 51 comes into contact with the outside surface of the arc tube 11, is slipped on and attached.

FIG. 6 is a schematic of a conventional discharge lamp of the short arc type in which the trigger wire is wound differently. The arc tube 11 is provided with the remainder of the filler tip 1*a*. The trigger wire 5 is provided with an attachment part 50 which is attached by one end being wound around the remainder of the filler tip 1*a*. A holding part 52 which extends in the lengthwise direction of the lamp is connected to this attachment part 50. Part of this holding part 52 is wound around the side tube part 12 which is connected to the arc tube 11, and attached. One end of the holding part 52 is connected to the base 42.

The lamp shown in FIG. 7 has a base 41 that is provided with an installation part 41*a* of a diameter D' that is greater than the maximum diameter D of the arc tube 11 and which is used for mounting the lamp is mounted in a device. In such a case in which the diameter D' of this installation part 41*a* is greater than the maximum diameter D of the arc tube 11, there is the disadvantage that the trigger wire 5 which is shown in FIG. 4, having the uninterrupted annular area 51, cannot be inserted onto the lamp from the direction of the base 41, because the diameter of the annular area 51 of the trigger wire 5 is smaller than the maximum outside diameter of the arc tube 11, and thus, smaller than the diameter of the installation part 41*a*.

In this case, as is shown in FIG. 8, the annular area 51 is inserted onto the lamp from the base 42 on the opposite side, the annular area 51 is located on the outside surface of the arc tube 11 and one end of the holding part 52 is connected to the base 41.

In the operating process, in which a high voltage is applied to the cathode 22 which is located on the side opposite the anode 21 and which is not electrically connected to the trigger wire 5, the trigger wire 5 being electrically connected to the anode 21 via the base 41, the high voltage is not applied to the trigger wire 5. The trigger function therefore does not take effect here. In a lamp in which such an operating process is undertaken, therefore, there is inevitably the disadvantage that the trigger wire cannot be in the optimum state.

The lamp shown in FIG. 6 has the remainder of a filler tip 1*a* for attachment of the trigger wire 5. However, in a lamp which does not have a remainder of a filler tip 1*a*, there is the disadvantage that the winding process shown in FIG. 6 cannot be used to wind the trigger onto the arc tube.

Furthermore, in an arrangement of the trigger wire as is shown in FIG. 5, there is also a process in which the shape of the trigger wire does not have a given shape beforehand, but in which the wire-like component which is to become the trigger wire is bent on the outside surface of the arc tube and installed. This case is described below using FIG. 4. By bending this wire-like component into a ring shape, an annular area 51 is formed. Afterwards, using a tool, such as pliers or the like, one end of the annular area 51 is bent around. The wire-like component is turned such that the annular area 51 is formed uninterruptedly in alignment and that the length of the wire-like component comprising the annular area 51 thereafter never changes. A holding part 52 can also be made in alignment on this turned area.

When such a process is used in which a wire-like component which is to become the trigger wire is bent and installed on the surface of the arc tube, it becomes possible to arrange the trigger wire on the arc tube with optimum directional capacity, regardless of what kind of electrode, whether anode or cathode, to which the high voltage is applied. However, it is necessary to carry out the work of bending or twisting the wire-like component on the surface of the arc tube into an annular shape. This poses the disadvantage that the tool can come into contact with the surface of the arc tube and the surface of the arc tube is scratched as a result.

In the case of the trigger wire 5 which is shown in FIG. 6, there is also the disadvantage that, when the trigger wire 5 is attached in the remainder of the filler tip 1*a*, the tool comes into contact with the surface of the arc tube 11 and the surface 11 of the arc tube is scratched.

SUMMARY OF THE INVENTION

The invention was devised to eliminate the above described defects in the prior art. Thus, a primary object of the present invention is to devise a discharge lamp of the short arc type in which the following is enabled:

There can be a trigger wire even in a lamp which has a base with a diameter which is larger than the maximum outside diameter of the arc tube;

The trigger wire can be arranged in the state which is appropriate to the alignment of the electrode to which a high voltage is applied during operation;

The trigger wire is located on the arc tube at an optimum site, even if the arc tube does not have any remainder of the filler tip; and The arc tube is not scratched when the trigger wire is installed on it.

The object is achieved in the invention described, according to the invention, in a discharge lamp of the short arc type in which a pair of electrodes are located within an arc tube and in which the outside surface of this arc tube is provided with a trigger wire, in that the above described trigger wire has:

an annular area which is elastically deformed when the trigger wire is installed on the outside surface of the arc tube and which is looped around the arc tube and attached;

a first holding part adjoins one end of the annular area and extends in the axial direction of the arc tube;

a second holding part adjoins the other end of the annular area and extends in the axial direction of the arc tube.

The invention is described below using drawings.

BRIEF DESCRIPTION OF THE DRAWINGS

FIG. 1 shows a schematic of a discharge lamp of the short arc type according to the invention;

FIGS. 2(*a*) & 2(*b*) each show a schematic of the trigger wire which is located on a discharge lamp of the short arc type in accordance with the invention;

DETAILED DESCRIPTION OF THE INVENTION

Figure 3A:
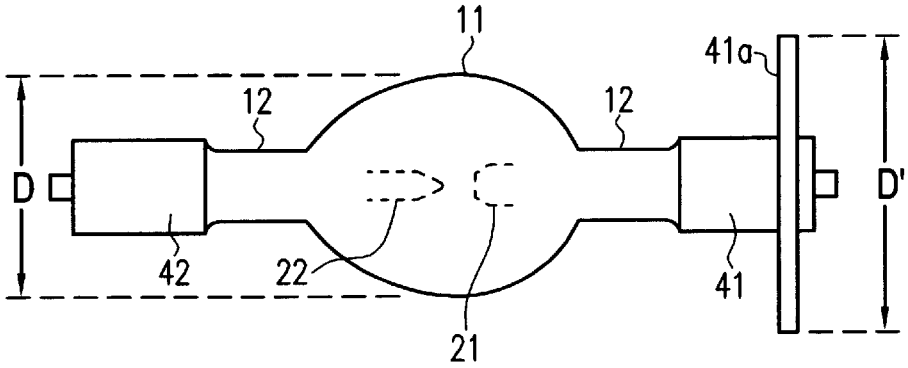
FIGS. 3(*a*) to 3(*d*) each show a schematic of the process by which the trigger wire is installed on a discharge lamp of the short arc type in accordance with the invention.

A discharge lamp of the short arc type according to the invention is described below with reference to FIG. 1. Here, there is a pair of electrodes, i.e., an anode 21 and a cathode 22 within the arc tube 11. A respective side tube part 12 adjoins each of opposite sides of the arc tube 11. A base 41 is formed on the outer end of the side tube part 12 at one side of the arc tube 11, and is electrically connected to the anode 21. On the opposite side of the arc tube 11, a base 42 is formed on the outer end of the side tube part 12 and is electrically connected to the cathode 22. A trigger wire 3 located on the outside surface of the arc tube 11.

Part of the trigger wire 3 is turned one time. Thus, an annular area 31 is formed which has a smaller diameter than the maximum outside diameter D of the arc tube 11 and which comes into contact with the outside surface of the arc tube 11 when it is slipped on, and attached.

This annular area 31 adjoins a holding part 32*a* and another holding part 32*b* which extend in the lengthwise direction of the lamp. These holding parts 32*a*, 32*b* adjoin an attachment part 33 which is wound around the side tube part 12 and by which the trigger wire 3 is attached. This attachment part 33 adjoins a connection part 34 which is connected to the base 42 and attached. A high voltage is applied to the cathode 22 in this lamp. An insulation breakdown occurs within the arc tube 11 between the annular area 31 formed on the outside surface of the arc tube 11 and the anode 21, and thus the lamp is operated.

The trigger wire 3 is explained in detail below.

FIGS. 2(*a*) & 2(*b*) show only the trigger wire 3. The trigger wire 3 was produced such that a wire-like component of stainless steel with a diameter of 0.5 mm was bent such that it is matched to the shape of the arc tube 11 and the shape of the side tube part 12. In the state prior to installation in the arc tube, it is already bent into a given shape.

As shown in FIG. 2(*a*), in the annular area 31 of the trigger wire 3 part of the wire-like component which is to become the trigger wire 3, the wire has been turned at least one time and is formed such that, prior to installation in the arc tube, it has a diameter d which is smaller than the maximum diameter D of the arc tube 11 shown in FIG. 1.

One end of this annular area 31 is adjoined by the holding part 32*a* which extends in the axial direction of the arc tube 11. The other end of the annular area 31 is adjoined by the other holding part 32*b* which extends in the axial direction of the arc tube 11. The annular area 32 differs from the uninterrupted annular area of the conventional trigger wire and has an arrangement in which the two ends of the annular area 31 are not connected to one another.

In the case of installation of the trigger wire 3 on the outside surface of the arc tube 11, the annular area 31 deforms elastically, as is shown in FIG. 2(*b*), and widens in such a way that an increased diameter d' of the annular area 31 is obtained because the two ends of the annular area 31 are not connected to one another and because holding part 32*a* and the other holding part 32*b* are connected individually and independently of one another to the two sides of the area.

Figure 3B:
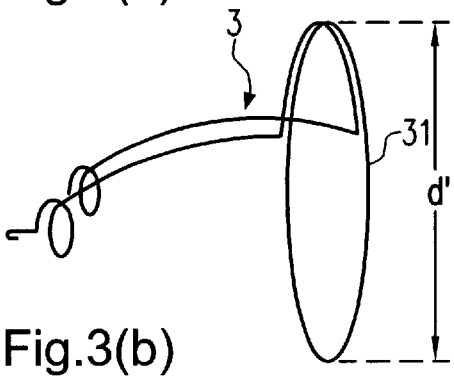
Figure 3C:
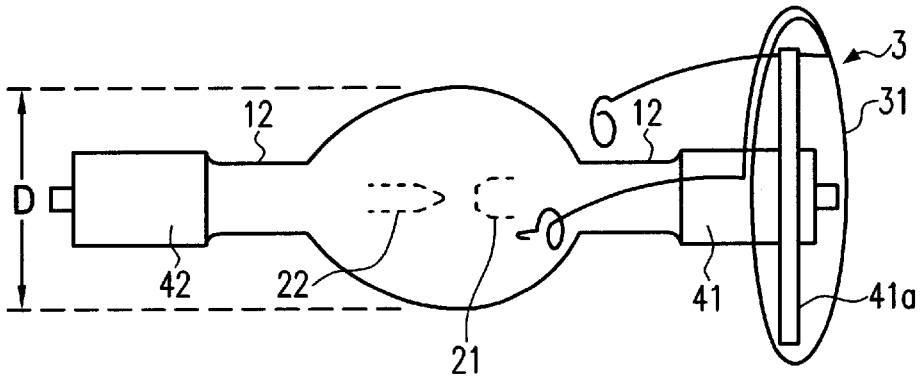
Figure 3D:
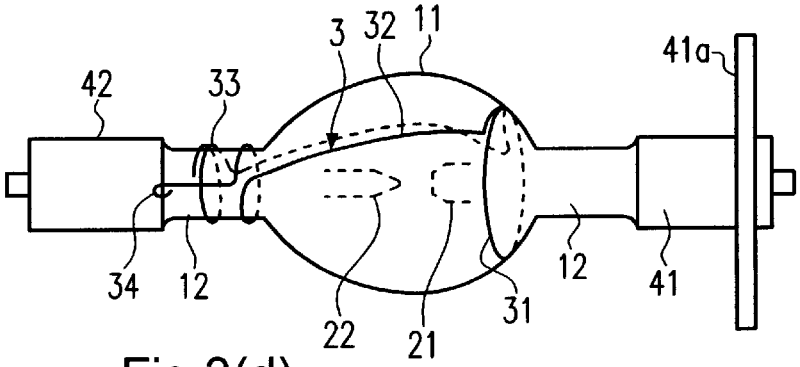
Figure 4:
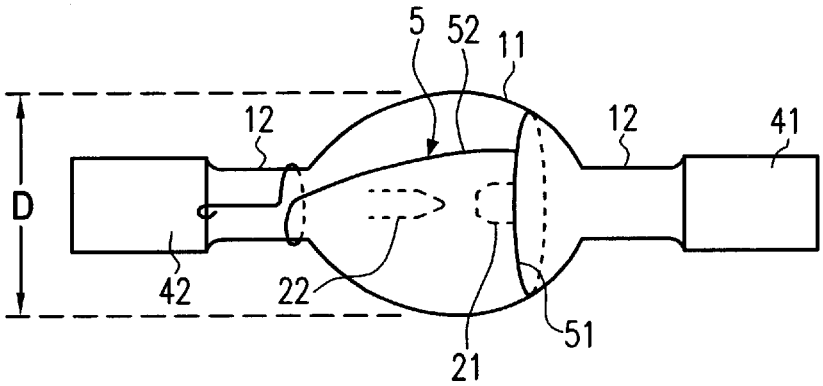
Fig.4 (Prior Art)
FIG. 4 shows a schematic of a conventional discharge lamp of the short arc type.
Figure 5:
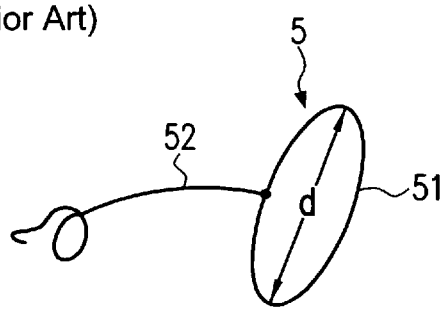
Fig.5 (Prior Art)
FIG. 5 shows a schematic of the trigger wire which is located on a conventional discharge lamp of the short arc type.
Figure 6:
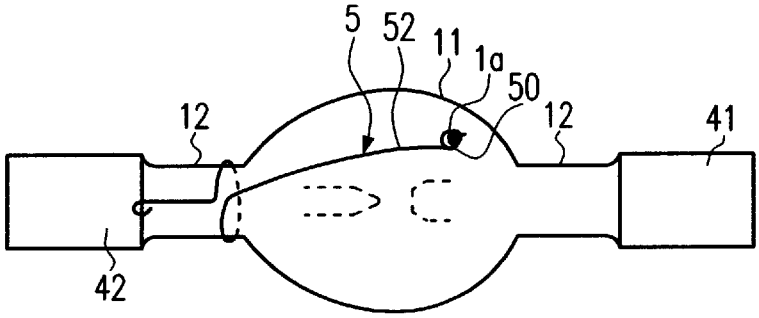
Fig.6 (Prior Art)
FIG. 6 shows a schematic of another conventional discharge lamp of the short arc type.
Figure 7:
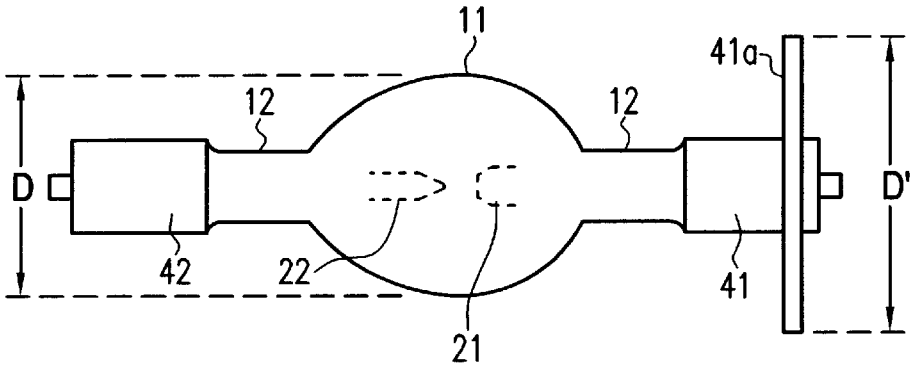
Fig.7 (Prior Art)
FIG. 7 shows a schematic of a conventional discharge lamp of the short arc type in which the base is provided with an installation part.
Figure 8:
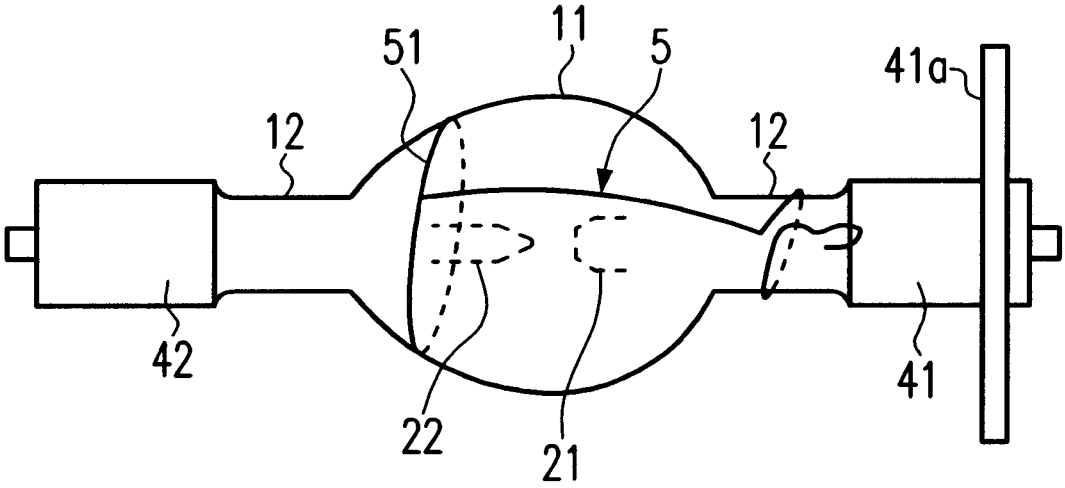
Fig.8 (Prior Art)
FIG. 8 shows a schematic of a conventional discharge lamp of the short arc type in the case in which the arrangement of the trigger wire is inappropriate.

FIGS. 3(*a*), 3(*b*), 3(*c*), & 3(*d*) each show, in a schematic, the installation of the trigger wire on a short arc lamp in which a base with a larger diameter than the maximum diameter of the arc tube is located. In this lamp, a high voltage is applied to the cathode 22 during operation, and it is necessary to position the annular area 31 of the trigger wire on the outside surface of the arc tube 11 in the vicinity of the anode 21.

As is shown in FIG. 3(*a*), in this lamp there is a base 41 which has an installation part 41*a* which has a larger diameter D' than the maximum diameter D of the arc tube 11. The trigger wire 3, as shown in FIG. 3(*b*), before installation in the arc tube 11, is widened beforehand with bare hands or with a tool such that the diameter of the annular area 31 of the trigger wire 3 increases and the diameter d' is made larger than the diameter D' of the installation part 41*a*.

Next, as shown in FIG. 3(*c*), proceeding from the FIG. 3(*b*) state, the annular area 31 is inserted over the base 41. Afterwards, the force with which the diameter of the annular area 31 has been increased in the stage in which the annular area 31 has passed through the installation part 41*a* is released. By means of the inherent spring force of the annular area 31 the diameter of the annular area 31 can be made smaller than the maximum outside diameter D of the arc tube 11 by itself. As a result, as shown in FIG. 3(*d*), the annular area 31 of the trigger wire 3 comes into contact with the outside surface of the arc tube 11. Next, the holding part 32 is extended along the lengthwise direction of the arc tube 11. The attachment part 33 is wound around the side tube part 12 and the connection part 34 is connected to the base 42 and attached.

In a modification of the process shown in FIGS. 3(*a*), 3(*b*), 3(*c*), & 3(*d*), the trigger wire can also be installed by inserting the annular area 31 over the base 42 which is shown in FIGS. 3(*a*), 3(*b*), & 3(*d*). In this case, as was described above, the diameter of the annular area 31 of the adjusted trigger wire 3 is widened beforehand such that it passes over the area with the maximum diameter D of the arc tube 11. After passage of the annular area 31 over the area with the maximum diameter D of the arc tube 11, the force with which the annular area 31 is being widened is released. In this way the diameter of the annular area 31 is reduced such that it agrees with the outside diameter of the arc tube 11. Thus, the annular area 31 is located on the outside surface of the arc tube 11.

The above described installation process involves a lamp in which a high voltage is applied to the cathode 22 during operation. Here, it has been described that the annular area 31 of the trigger wire 3 is positioned on the outside surface of the arc tube 11 in the vicinity of the anode 21. However, in the lamp in which, conversely, the high voltage is applied to the anode 21 during operation, it is necessary to position the annular area 31 of the trigger wire on the outside surface of the arc tube 11 in the vicinity of the cathode 22. This case differs from the above described installation process only in that the arrangement position of the annular area 31 is located on the outside surface of the arc tube 11 in the vicinity of the cathode 22 and is otherwise identical to the above described installation process. This means that there can be a trigger wire even in a lamp which has a base with a larger diameter than the maximum outside diameter of the arc tube 11. Furthermore, the trigger wire can be in the state which is appropriate to the alignment of the electrode to which the high voltage is applied during operation. Furthermore, for the trigger wire 3, since the annular area 31 comes into contact with the outside surface of the arc tube 11, is slipped on and attached, even in a lamp without a filler tip remainder on the arc tube 11, the trigger wire 3 can be safely located on the surface of the arc tube 11.

Moreover, instead of the process in which a wire-like component which is to become the trigger wire 3 is bent and installed on the outside surface of the arc tube 11 using a tool, a process is undertaken in which the trigger wire 3 is adjusted in the stage prior to installation in the arc tube 11 beforehand into a given shape and afterwards can be installed in the lamp, and the formation of scratches on the outside surface of the arc tube 11 by the tool is prevented.

Action of the Invention

As was described above, in the discharge lamp of the short arc type in accordance with the invention the effects are achieved:

- There can be a trigger wire even in a lamp which has a base with a diameter which is larger than the maximum outside diameter of the arc tube,
- The trigger wire can be in the state which is appropriate to the alignment of the electrode to which a high voltage is applied during operation;
- The trigger wire can be located in the arc tube at an optimum site, even if the arc tube does not have any remainder of the filler tip; and
- The arc tube is not scratched when the trigger wire is installed in it.

What we claim is:

1. Discharge lamp of the short arc type having an arc tube containing a pair of electrodes and a trigger wire on an outside surface of the arc tube, wherein said trigger wire comprises:

- an annular area formed by a portion of the trigger wire which is looped around the arc tube and elastically held against the outside surface of the arc tube;
- a first holding part which adjoins a first end of the portion of the trigger wire forming said annular area and which extends in an axial direction along the arc tube;
- a second holding part which adjoins a second end of end of the portion of the trigger wire forming said annular area and which extends in the axial direction along the arc tube.

2. Discharge lamp according to claim 1, wherein said portion of the trigger wire forming the annular area is formed of a loop of wire in excess of one full turn, said one full turn having a diameter in an unstressed condition that is smaller that a maximum diameter of said arc tube and a maximum diameter in a stress state that greater than said maximum diameter of the arc tube, the annular area being held on said arc tube in a stressed condition having a diameter that is greater than the diameter of said one full turn in the unstressed condition and less than said maximum diameter of the one full turn.

* * * * *